US008444813B2

(12) United States Patent
Zhong

(10) Patent No.: US 8,444,813 B2
(45) Date of Patent: May 21, 2013

(54) METHOD FOR PREPARING ARAMID PAPER AND THE ARAMID PAPER OBTAINED THEREFROM

(76) Inventor: Zhou Zhong, Shanghai (CN)

( * ) Notice: Subject to any disclaimer, the term of this patent is extended or adjusted under 35 U.S.C. 154(b) by 0 days.

(21) Appl. No.: 13/225,524

(22) Filed: Sep. 5, 2011

(65) Prior Publication Data

US 2012/0227919 A1 Sep. 13, 2012

(30) Foreign Application Priority Data

Feb. 24, 2011 (CN) ..... 2011 1 0044279

(51) Int. Cl.
*D21H 13/26* (2006.01)
*D21H 27/12* (2006.01)

(52) U.S. Cl.
USPC ..... 162/138; 162/146; 162/149; 162/192; 162/205; 162/216

(58) Field of Classification Search
USPC ..... 162/138, 141, 146, 157.1–157.3, 162/192, 204–206, 216, 149; 428/213, 299.7, 428/300.4
See application file for complete search history.

(56) References Cited

U.S. PATENT DOCUMENTS 3,547,775 A * 12/1970 Bossen et al. ..... 162/198
3,853,694 A * 12/1974 Parker ..... 162/216
4,698,267 A * 10/1987 Tokarsky ..... 428/474.4
4,729,921 A * 3/1988 Tokarsky ..... 428/326
5,792,321 A * 8/1998 Aidun ..... 162/216
5,979,664 A * 11/1999 Brodeur ..... 209/155
6,136,152 A * 10/2000 Begemann ..... 162/336
6,770,171 B2 * 8/2004 Hamalainen et al. ..... 162/198
6,902,650 B2 * 6/2005 Park et al. ..... 162/216
7,455,750 B2 * 11/2008 Conley et al. ..... 162/157.3
7,727,357 B2 * 6/2010 Amma ..... 162/157.3
7,727,358 B2 * 6/2010 Amma et al. ..... 162/157.3
7,740,741 B2 * 6/2010 Levit et al. ..... 162/157.3
7,744,724 B2 * 6/2010 Amma et al. ..... 162/157.3
7,803,247 B2 * 9/2010 Levit et al. ..... 162/146
8,075,736 B2 * 12/2011 Nakazawa et al. ..... 162/336
8,114,251 B2 * 2/2012 Levit et al. ..... 162/146
8,211,272 B2 * 7/2012 Levit et al. ..... 162/157.3
2002/0117285 A1 * 8/2002 Aidun ..... 162/336
2002/0121354 A1 * 9/2002 Aidun ..... 162/216
2004/0154775 A1 * 8/2004 Park et al. ..... 162/216
2005/0284595 A1 * 12/2005 Conley et al. ..... 162/146
2006/0157213 A1 * 7/2006 Ronnenberg ..... 162/192
2006/0266486 A1 * 11/2006 Levit ..... 162/146
2007/0137818 A1 * 6/2007 Levit et al. ..... 162/146
2007/0144695 A1 * 6/2007 Amma et al. ..... 162/146

(Continued)

*Primary Examiner* — Jose A Fortuna
(74) *Attorney, Agent, or Firm* — McNeely, Hare & War LLP; Kevin J. McNeely

(57) ABSTRACT

A method for preparing aramid insulating paper, includes the operations of: providing aramid pulp slurry and aramid short fiber slurry at respective desired concentrations; blending, beating and fluffing the aramid pulp slurry and the aramid short fiber slurry in a given ratio to afford a paper pulp at a desired concentration; transiting the paper pulp to a paper-making machine fitted with a head box to form and make wet paper sheets; pressing to dewater the wet paper sheets and drying the dewatered paper sheets; and calendering the dried paper sheets at a high temperature to obtain the aramid insulating paper, wherein in operation iii), at least one ultrasonic generator is mounted on the head box to apply directional ultrasonic waves to the paper pulp flowing through the heat box. The aramid insulating paper prepared according to the method of the invention has enhanced strength, smoothness and uniformity.

11 Claims, 1 Drawing Sheet

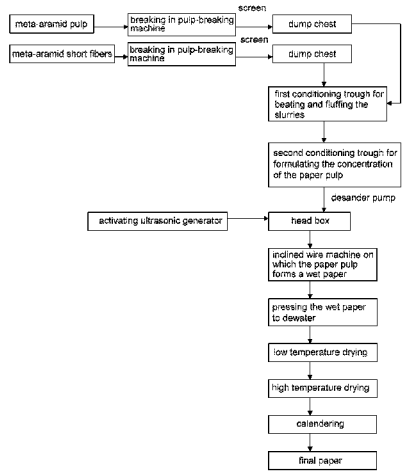

U.S. PATENT DOCUMENTS

2008/0023167 A1* 1/2008 Nakazawa et al. ..... 162/263
2008/0135198 A1* 6/2008 Tonello ..... 162/262
2009/0029885 A1* 1/2009 Conley et al. ..... 508/258
2010/0212851 A1* 8/2010 Levit et al. ..... 162/157.3
2011/0143110 A1* 6/2011 Tsuchiya et al. ..... 428/213
2012/0012263 A1* 1/2012 Tsuchiya et al. ..... 162/164.1
2012/0168983 A1* 7/2012 Zhong ..... 264/184
2012/0227919 A1* 9/2012 Zhong ..... 162/157.3

* cited by examiner

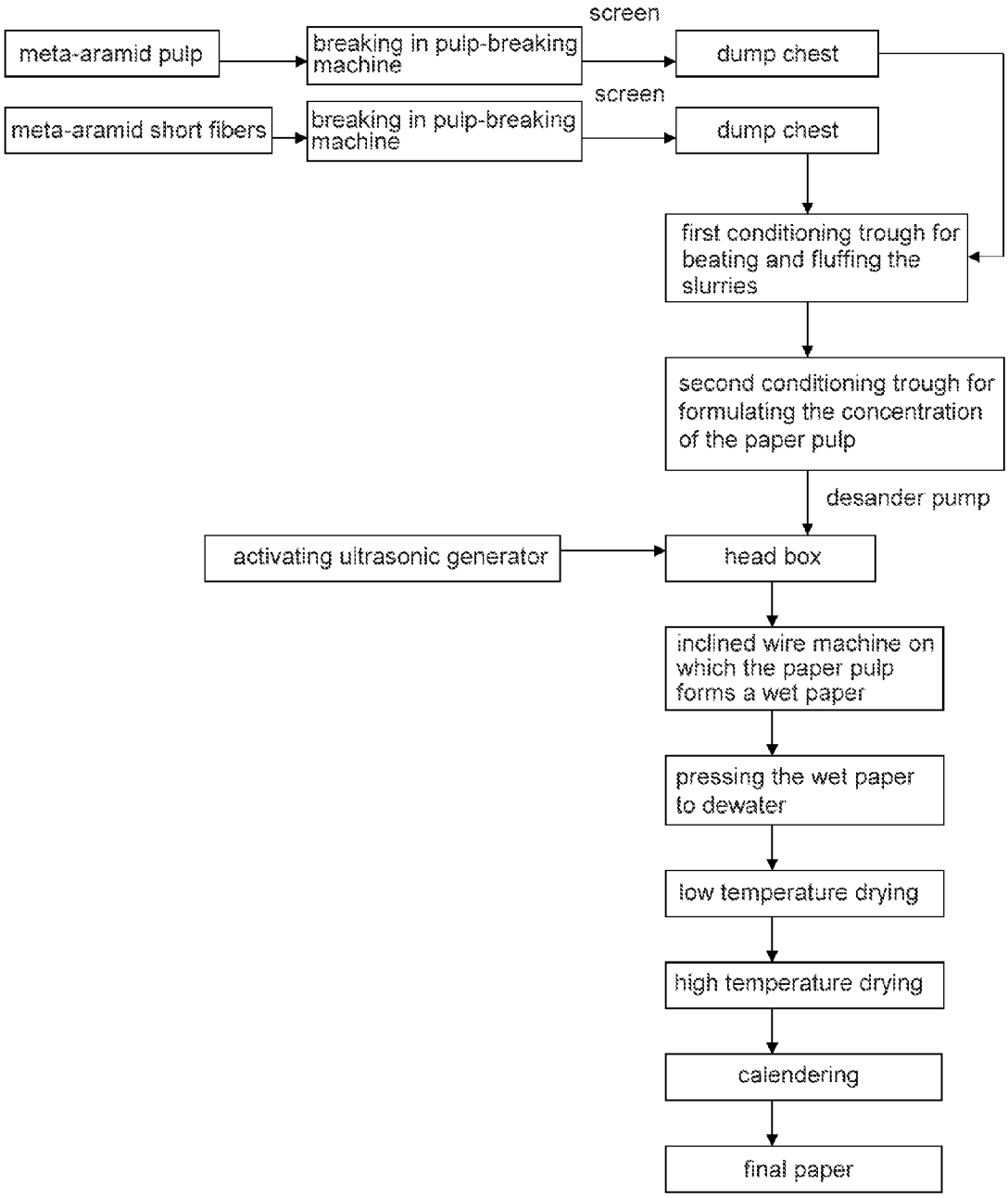
meta-aramid pulp
breaking in pulp-breaking machine
screen
dump chest
meta-aramid short fibers
breaking in pulp-breaking machine
screen
dump chest
first conditioning trough for beating and fluffing the slurries
second conditioning trough for formulating the concentration of the paper pulp
desander pump
activating ultrasonic generator
head box
inclined wire machine on which the paper pulp forms a wet paper
pressing the wet paper to dewater
low temperature drying
high temperature drying
calendering
final paper

METHOD FOR PREPARING ARAMID PAPER AND THE ARAMID PAPER OBTAINED THEREFROM

CROSS-REFERENCE TO RELATED APPLICATIONS

This utility patent application claims priority to Chinese patent application no. 201110044279.X filed on Feb. 24, 2011, which is incorporated by reference herein.

FIELD OF THE INVENTION

This invention relates generally to the technical field of production of synthetic fiber paper. More particularly, the invention relates to a method for preparing aramid paper and the aramid paper obtained from the method. The aramid paper of the invention exhibits enhanced strength since the aramid short fibers have increased degree of orientation and dispersion according to the method.

BACKGROUND OF THE INVENTION

Aramid insulating papers are also referred to as aramid papers, and generally classified into meta-aramid insulating papers and para-aramid insulating papers. Among others, the meta-aramid insulating papers exhibit good and persistent thermal stability, remarkable flame retardance, outstanding high temperature resistance and electrical insulation properties, and excellent chemical stability and mechanical properties, and therefore find a wide range of applications in aerospace, transportation and electronic industries as structural materials, insulating materials and filter materials.

The aramid insulating papers are generally made by blending and forming aramid short fibers and aramid pulp in a given ratio into papers, and pressing, drying and high temperature calendering the papers. The short fibers provide mechanical properties to the papers, and the aramid pulp comprises pulp fibers with rich capillary fibers to function as a binder. After the formation of the paper, heating and pressing the paper allow the aramid pulp having a lower melting point to melt, thereby binding to the short fibers.

Presently, a large portion of the aramid insulating papers are made of para-aramid short fibers, meta-aramid pulp and a third fiber or a binder. For example, Chinese patent no. ZL93106746.4 discloses a paper which is synthesized by para-aramid short fibers and meta-aramid pulp; Chinese patent no. ZL99125156.3 discloses papers made by aromatic polyamide fibers and a binder; Chinese patent no. ZL200410026569.1 discloses papers which were made using aromatic polyamide fibers, poly(p-phenylene benzobisoxazole) fibers and fibrillating fibers as raw materials. The above patents emphasize the proportioning of the aramid fibers and the heat-pressing technology, and the final papers in these patents are mixed papers of different materials.

Another Chinese patent application no. 200610043659.4 provides a method for preparing meta-aramid papers using meta-aramid fibers only, comprising the operations of adding 5-95 wt % meta-aramid short fibers into water to form a short fiber slurry and adding 5-95 wt % meta-aramid fibrids into water to form a fibrid slurry; blending the two slurries; forming the blended slurries into papers on a papermaking machine; pressing, drying and high temperature calendering the papers to make final papers. This patent application has solved the problem of dispersing the meta-aramid fibers in the raw material stage, but fails to elaborate the technology of papermaking.

Ultrasonic waves are sonic waves having frequency higher than 20000 Hz. They exhibit good orientation and high penetrability, are able to radiate centralized acoustic energy and have a long propagation length in water. Therefore, the ultrasonic waves are widely used in military affairs, medicine, industry, and agriculture. It is well known that ultrasonic waves are characterized by directional straight propagation, cavitation and mechanical effects, and contribution to dispersion of solids, due to high frequency and short wave length.

The dispersion and flocculation of the paper pulp are known to seriously affect the mechanical strength and uniformity of the aramid insulating papers, and the degree of orientation of the short fibers also has a great impact on the mechanical strength of the aramid insulating papers. The invention has solved the above problems by utilizing the ultrasonic waves in the papermaking process to produce the aramid papers exhibiting enhanced mechanical strength and increased smoothness and uniformity.

SUMMARY OF THE INVENTION

An object of the invention is to provide a method for preparing aramid insulating paper in which the ultrasonic waves are applied to the paper pulp so as to boost the dispersion of the aramid short fibers, substantially decrease the amount of degree of vertical orientation of the short fibers, and increase the amount of degree of horizontal orientation of the short fibers along the flow direction. In this way, the aramid insuating paper of the invention has enhanced strength.

This object and advantages of the invention are satisfied by providing a method for preparing aramid insulating paper, comprising the operations of:

i) providing aramid pulp slurry and aramid short fiber slurry at respective desired concentrations;

ii) blending, beating and fluffing the aramid pulp slurry and the aramid short fiber slurry in a given ratio to afford a paper pulp at a desired concentration;

iii) transiting the paper pulp to a papermaking machine fitted with a head box to form and make wet paper sheets;

iv) pressing to dewater the wet paper sheets and drying the dewatered paper sheets; and v) calendering the dried paper sheets at a high temperature to obtain the aramid insulating paper, wherein in operation iii), at least one ultrasonic generator is mounted on the head box to apply directional ultrasonic waves to the paper pulp flowing through the heat box.

Preferably, the directional ultrasonic waves propagate in a direction parallel to a direction along which the paper pulp flows. More preferably, the at least one ultrasonic generator is mounted across two ends of upstream of the head box, such that the propagation direction of the ultrasonic waves generated by the ultrasonic generator and the flow direction of the paper pulp are the same.

In one embodiment of the invention, in operation i), the aramid pulp slurry is provided at a concentration of 3-7 wt % preferably 4.5-5.5 wt %, and the aramid short fiber slurry is provided at a concentration of 2-7 wt %, preferably 3-4 wt %.

According to the model number of the aramid paper to be made, the aramid pulp slurry and the aramid short fiber slurry are blended in a given ratio in operation ii). Generally, the paper pulp comprises 20-70 wt % of the aramid pulp and 30-80 wt % of the aramid short fiber, and the resultant paper pulp has a concentration of 0.5-3 wt %.

In one preferred embodiment of the invention, operation iii) utilizes an inclined wire machine as the papermaking machine.

According to the invention, the ultrasonic waves have a frequency in a range of 10 to 100 kHz, preferably 20 to 45 kHz. The most used frequency is 20 kHz, 30 kHz, 35 kHz and 42 kHz.

Advantageously, the ultrasonic generator may be provided with a power regulator to allow for operationless smooth power, in order to prevent the waves from beating to maintain the stability.

Unlike the drying process of the prior art which is performed at one temperature, the drying of the invention comprises two stages, wherein a first stage of drying is performed at a temperature ranging from 105-115° C. preferably 110° C., and then a second stage of drying is performed at a temperature ranging from 145-155° C. preferably 150° C.

Another aspect of the invention relate to the aramid paper prepared according to the method of the invention.

In the method for the preparation of aramid paper according to the invention, at least one ultrasonic generator is mounted on the head box of the papermaking machine to apply the directional ultrasonic waves to the paper pulp flowing through the head box. Therefore, the ultrasonic waves can induce cavitation and mechanical effects with transmission of high energy, when they propagate in the paper pulp. The ultrasonic waves form standing waves in the fluid flow, the aramid pulp and the short fibers suspending in the fluid flow would move periodically in the antinodes, with a result that agglomeration and accumulation of the fibers are avoided. The cavitation effect of the ultrasonic waves on the paper pulp results in plenty of fine bubbles which continuously move, grow and burst suddenly along with the vibration of the fluid flow. The movement of the fine bubbles facilitates the uniform dispersion of the aramid pulp and the short fibers to avoid the agglomeration phenomenon. The ultrasonic waves can also propagate in solid medium, and the aramid short fibers can be caused by the energy of the ultrasonic waves to move in a direction generally parallel with the propagation direction of the ultrasonic waves. Consequently, the degree of horizontal orientation of the short fibers is increased, which in turn enhances the strength of the aramid paper.

To have a better understanding of the advantages and the technical effects of the invention reference is made to the following detailed description of the invention and embodiments thereof.

BRIEF DESCRIPTION OF THE DRAWINGS

FIG. 1 is a flow chart of preparing aramid insulating paper according to one embodiment of the invention.

DETAILED DESCRIPTION OF THE PREFERRED EMBODIMENTS

As illustrated in FIG. 1, a pure meta-aramid pulp and pure meta-aramid short fibers are used as raw materials to prepare meta-aramid insulating paper in this embodiment. Of course, para-aramid insulating paper may be prepared in the same way. The following is the detailed description of the process of the embodiment of the invention.

The first operation is to provide the meta-aramid pulp slurry and the meta-aramid short fiber slurry. In particular, the meta-aramid pulp and water are added into a hydraulic pulp-breaking machine where they are broken to afford the slurry at a concentration of 3-7 wt %, preferably 4.5-5.5 wt %; and the meta-aramid short fibers and water are added into a hydraulic pulp-breaking machine where they are broken to afford the slurry at a concentration of 2-7 wt %, preferably 3-4 wt %.

Screening of the meta-aramid pulp slurry and the meta-aramid short fiber slurry is carried out on a high frequency vibration screen for the slurries of good quality. The screened slurries are then fed into the respective dump chests. The two slurries are pumped into a conditioning trough for blending. The ratio of the meta-aramid pulp slurry to the meta-aramid short fiber slurry is adjusted according to the model number of the final aramid paper. Different model numbers have different applications and thus possess different parameters of properties, as a consequence, requiring different ratios of the meta-aramid pulp slurry to the meta-aramid short fiber slurry. Generally, the aramid paper comprises 20-70 wt % of the aramid pulp and 30-80 wt % of the aramid short fiber.

Two conditioning troughs are used in the embodiment. The meta-aramid pulp slurry and the meta-aramid short fiber slurry in a desired ratio are blended, beaten and fluffed in a first conditioning trough, such that the two slurries are blended uniformly and the fibers are fluffed, defibrated and cut off appropriately to satisfy the requirement for the papermaking machine. The slurries from the first conditioning trough are fed into a second conditioning trough into which deionized water is added to formulate the required concentration (for example 0.5-3 wt %) of the paper pulp.

The paper pulp flowing out of the second conditioning trough is transported to a desander pump for removal of impurities, and then to an inclined wire machine to form and prepare a paper. The inclined wire machine is known in the art to comprise a head box for rectification of the paper pulp. The head box of the invention has an ultrasonic generator for application of the directional ultrasonic waves to the paper pulp flowing through the head box, which is not available to the prior art. Transmission of ultrasonic waves is used in the embodiment. In particular, the ultrasonic generator is mounted across the two ends of upstream of the head box along the flow direction, hence, the propagation direction of the ultrasonic waves generated by the ultrasonic generator and the flow direction of the paper pulp are the same. It would be appreciated that the propagation direction of the ultrasonic waves generated by the ultrasonic generator and the flow direction of the paper pulp may be opposite.

With the application of the ultrasonic waves, the water in the head box vibrates horizontally in the generally same direction, with a result that the degree of horizontal orientation of the meta-aramid short fibers is increased and the vertical distribution of the short fibers is reduced, thereby leading to enhanced mechanical strength of the aramid paper. Moreover, the cavitation and mechanical effects of the ultrasonic waves enable the paper pulp suspension to disperse uniformly, thereby decreasing the flocculation of the meta-aramid fibers and the aramid pulp. This contributes to the obtension of smooth, uniform and wrinkle-free paper sheets.

The frequency of the ultrasonic generator ranges from 10 to 100 kHz, preferably 20-45 kHz. The most-used frequency is 20 kHz, 30 kHz, 35 kHz and 42 kHz.

The ultrasonic generator may be provided with a power regulator to allow for operationless smooth power, in order to prevent the waves from beating to maintain the stability. The paper pulp is formed into wet paper sheets under the action of the ultrasonic waves. After removal from the inclined wire machine, the wet paper sheets are subject to pressing rollers for dewatering.

The drying process of the invention differs from the prior art. In particular, the current drying process of the prior art uses only one temperature which is relatively high, for example 150° C. Therefore, the wet paper sheets are susceptible to formation of wrinkle and shrinkage. The method of the invention has made an improvement in the drying operation by using two drying stages in a contact-type oven. The first stage of drying is performed at a temperature ranging from 105-115° C. preferably 110° C. Because the wet paper sheets removed from the inclined wire machine contain high contents of water, drying the wet paper sheets at a relatively low temperature is advantageous to the uniform dewatering, which ensures to prevent the paper sheets from shrinking due to excessive localised heating of the paper sheets. When the contents of water present in the wet paper sheets are less than about 2%, the paper sheets will be subject to the second stage of drying in which the temperature is increased to 145-155° C. preferably 150° C. Then the water can be removed thoroughly from the paper sheets. The two-stage drying of the invention ensures that the wet paper sheets are not prone to wrinkling during the drying and have the high degree of smoothness.

The dried aramid papers are subject to sequential treatments of calendering, rewinding, cutting and packing to afford the final aramid papers. The treatment of calendering may be performed at 200-350° C. under 110-300 kg/cm.

The invention will be elaborated with reference to the specific examples.

The meta-aramid pulp and the meta-aramid short fibers used in the following experimental description were prepared by SRO Group (China) Limited.

The data provided in the examples described below are obtained as followed: Quantification of Weight: GB/T 451.3-2002; Thickness: GB/T 451.3-2002; Tension: xGB/T 451.3-2002; Tensile Strength: GB/T 453-2002; Elongation: GB/T 453-2002, Tear Strength: GB/T 455-2002.

Example

The aramid insulating paper was prepared according to the following procedure. 5% of meta-aramid pulp was broken in the hydraulic pulp-breaking machine to afford the meta-aramid pulp slurry which was fed into the dump chest of pulp slurry. 3% of meta-aramid short filbers were broken in the hydraulic pulp-breaking machine to afford the meta-aramid short fiber slurry which was fed into the dump chest of short fiber slurry. The meta-aramid pulp slurry and the meta-aramid short fiber slurry in a ratio of 2:5 were pumped from the respective dump chests into the conditioning troughs where the two slurries were blended, beaten and fluffed, and then formulated into the paper pulp at the concentration of 1.10%. The paper pulp was transported to the inclined wire machine to form a paper under the application of ultrasonic waves generated by the ultrasonic generator with power 15 kw at a frequency of 30 kHz. The wet paper was pressed to dewater, dried, and calendered to make a final paper which comprises the aramid pulp and the short fibers in a ratio of 40:60. The final paper was tested for its performance and the test results were given in Table 1 below.

TABLE 1

| Tested Items | | Unit | Average Value |
|---|---|---|---|
| quantification of weight | | $g/m^2$ | 62.4 |
| thickness | | mm | 0.084 |
| tensile strength | lateral MD | N/cm | 75.3 |
| | longitudinal CD | N/cm | 38.1 |
| elongation | lateral MD | % | 11.9 |
| | longitudinal CD | | 7.8 |
| dielectric strength | | kV/mm | 23.2 |

Comparative Example

The aramid insulating paper was prepared according to the following procedure. 5% of meta-aramid pulp was broken in the hydraulic pulp-breaking machine to afford the meta-aramid pulp slurry which was fed into the dump chest of pulp slurry. 3% of meta-aramid short filbers were broken in the hydraulic pulp-breaking machine to afford the meta-aramid short fiber slurry which was fed into the dump chest of short fiber slurry. The meta-aramid pulp slurry and the meta-aramid short fiber slurry in a ratio of 2:5 were pumped from the respective dump chests into the conditioning troughs where the two slurries were blended, beaten and fluffed, and then formulated into the paper pulp at the concentration of 1.10%. The paper pulp was transported to the inclined wire machine to form a paper without the application of ultrasonic waves. The wet paper was pressed to dewater, dried, and calendered to make a final paper which comprises the aramid pulp and the short fibers in a ratio of 40:60. The final paper was tested for its performance and the test results were given in Table 2 below.

TABLE 2

| Tested Items | | Unit | Average Value |
|---|---|---|---|
| quantification of weight | | $g/m^2$ | 62.4 |
| thickness | | mm | 0.084 |
| tensile strength | lateral MD | N/cm | 54.7 |
| | longitudinal CD | N/cm | 31.2 |
| elongation | lateral MD | % | 9.5 |
| | longitudinal CD | | 6.3 |
| dielectric strength | | kV/mm | 15.6 |

The above examples revealed that the aramid insulating paper prepared by the method of the invention is significantly better than the aramid insulating paper prepared by the conventional method in terms of tensile strength, elongation, dielectric strength and the like. It is obvious that application of the ultrasonic waves to the paper pulp not only enables uniform dispersion of the aramid pulp and the short fibers to avoid the agglomeration phenomenon, but also improves the degree of orientation of the short fibers. As a result, the final paper exhibits enhanced strength, smoothness and uniformity.

While the embodiments described herein are intended as exemplary methods for preparing meta-aramid papers, it will be appreciated by those skilled in the art that the present invention is not limited to the embodiments illustrated. Those skilled in the art will envision many other possible variations and modifications by means of the skilled person's common knowledge without departing from the scope of the invention, however, such variations and modifications should fall into the scope of this invention.

What is claimed is:

1. A method for preparing aramid insulating paper, the method comprising:

i) providing aramid pulp slurry and aramid short fiber slurry at respective desired concentrations;

ii) blending, beating and fluffing the aramid pulp slurry and the aramid short fiber slurry in a given ratio to afford a paper pulp at a desired concentration;

iii) transiting the paper pulp to a papermaking machine fitted with a head box to form and make wet paper sheets;

iv) pressing to dewater the wet paper sheets and drying the dewatered paper sheets; and v) calendering the dried paper sheets at a high temperature to obtain the aramid insulating paper;

wherein in operation iii), at least one ultrasonic generator is mounted upstream of the head box to apply directional ultrasonic waves to the paper pulp flowing through the head box, and the directional ultrasonic waves propagate in a direction parallel to a direction along which the paper pulp flows.

2. A method as claimed in claim 1, wherein in operation i), the aramid pulp slurry is provided at a concentration of 3-7 wt %, and the aramid short fiber slurry is provided at a concentration of 2-7 wt %.

3. A method as claimed in claim 2, wherein the aramid pulp slurry is provided at the concentration of 4.5-5.5 wt %, and the aramid short fiber slurry is provided at the concentration of 3-4 wt %.

4. A method as claimed in claim 1, wherein in operation ii), the paper pulp comprises 20-70 wt % of the aramid pulp and 30-80 wt % of the aramid short fiber.

5. A method as claimed in claim 1, wherein in operation ii), the resultant paper pulp has a concentration of 0.5-3 wt %.

6. A method as claimed in claim 1, wherein in operation iii), the papermaking machine is an inclined wire machine.

7. A method as claimed in claim 1, wherein the ultrasonic waves have a frequency in a range of 10 to 100 kHz.

8. A method as claimed in claim 7, wherein the frequency of the ultrasonic waves are in a range of 20 to 45 kHz.

9. A method as claimed in claim 1, wherein the ultrasonic generator is provided with a power regulator to allow for operationless smooth power.

10. A method as claimed in claim 1, wherein in operation iv), the drying comprises two stages, wherein a first stage of drying is performed at a temperature ranging from 105-115° C., and a second stage of drying is performed at a temperature ranging from 145-155° C.

11. A method as claimed in claim 10, wherein the first stage of drying is performed at 110° C., and the second stage of drying is performed at 150° C.

* * * * *